US005393119A

United States Patent [19]

Mukai

[11] Patent Number: 5,393,119

[45] Date of Patent: Feb. 28, 1995

[54] CHAIR BATH

[75] Inventor: Baietsu Mukai, Osaka, Japan

[73] Assignee: Mitsuru Haruyama, Osaka, Japan

[21] Appl. No.: 51,642

[22] Filed: Apr. 26, 1993

[30] Foreign Application Priority Data

Jun. 22, 1992 [JP] Japan ..... 4-205868
Dec. 10, 1992 [JP] Japan ..... 4-360713

[51] Int. Cl.[6] ..... A47C 7/62

[52] U.S. Cl. ..... 297/217; 4/540; 4/578.1

[58] Field of Search ..... 297/217; 5/81.1, 86.1; 4/540, 554, 546, 585, 587, 578.1, 560.1, 571.1, 573.1, 579

[56] References Cited

U.S. PATENT DOCUMENTS 3,366,978 2/1968 Jones ..... 4/578.1 X
3,614,791 10/1971 Newburger ..... 4/540
3,641,596 2/1972 Bill ..... 4/540
3,924,278 12/1975 Ekman ..... 4/579 X
4,785,486 11/1988 Viesturs ..... 4/585
4,888,834 12/1989 Vago ..... 4/540
5,103,509 4/1992 Richards ..... 4/578.1 X

FOREIGN PATENT DOCUMENTS 2436850 2/1976 Germany ..... 4/573.1

*Primary Examiner*—Laurie K. Cranmer
*Attorney, Agent, or Firm*—Wenderoth, Lind & Ponack

[57] ABSTRACT

A chair bath has a base frame and a bathtub mounted on the base frame so as to be pivotable about a transverse axis. The bathtub can be pivoted to a horizontal position. Thus, it is not necessary to carry a person into and out of the bathtub. A locking mechanism is provided for locking the bathtub in any desired position. A seat is mounted on the bathtub so that it can be pulled forward out of the bathtub.

5 Claims, 8 Drawing Sheets

CHAIR BATH

BACKGROUND OF THE INVENTION

This invention relates to a chair bath for old or physically handicapped people.

There are known various means which help those people who cannot take a bath unassisted to take a bath. Such means include a lift for lifting a naked person and carry him or her into a bathtub and a hydraulic device for elevating a water-filled bathtub. Another method is to place a bed-ridden person on a low-seated carriage and move the carriage along a moderate slope extending between a washing place and the bottom of a bathtub. These devices are, however, all for use in specialized institutions and are not intended for use at home. An ordinarily practiced method for bathing a bed-ridden person at home comprises the steps of bringing a compact handy bathtab into his or her bedroom, carrying him or her into the bathtub by hand and pouring warm water into the bathtub. After use, the water-filled bathtub has to be carried out by hand to a place where the water can be discarded.

The above-described conventional devices used in specialized institutions have a problem in that human labor is needed when carrying a person from the bed to a wheelchair in order to take him or her to a bathroom, or carrying him or her to a showering chair used when taking a shower, or to the above-described lift or low-seated carriage. At home, much greater human labor is required for carrying a bed-ridden person between the bed and the bathtub. Helpers are thus put under immense physical and mental stresses. Those who are helped will also feel ill at ease considering the difficulty of their helpers. Also, they may feel uneasy when they are carried by helpers for fear that they may be dropped.

SUMMARY OF THE INVENTION

An object for the present invention is to provide a device which eliminates the need of carrying a bed-ridden person by hand into and out of a bathtub.

The chair bath according to the present invention has the combined functions of a wheelchair, a showering chair and a bathtub. Thus, there is no need to lift and carry a person from one piece of equipment to another.

In accordance with the present invention, there is provided a chair bath comprising a base frame, a bathtub mounted on the base frame so as to be pivotable about a transverse axis, means for locking the bathtub, and a seat mounted in the bathtub so that it can be pulled forward out of the bathtub.

The chair bath according to the present invention eliminates the need of lifting and carrying a bed-ridden person from one place to another in order to bathe him. Helpers are thus freed from hard labor. Those who are helped can take a bath in a peaceful state of mind. At hospitals or other specialized institutions, bed-ridden or other physically handicapped people can be bathed efficiently and safely while saving helpers much labor. At home, a bed-ridden patient can be taken to a bathroom with much ease. Thus, he can take a bath more frequently.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1:
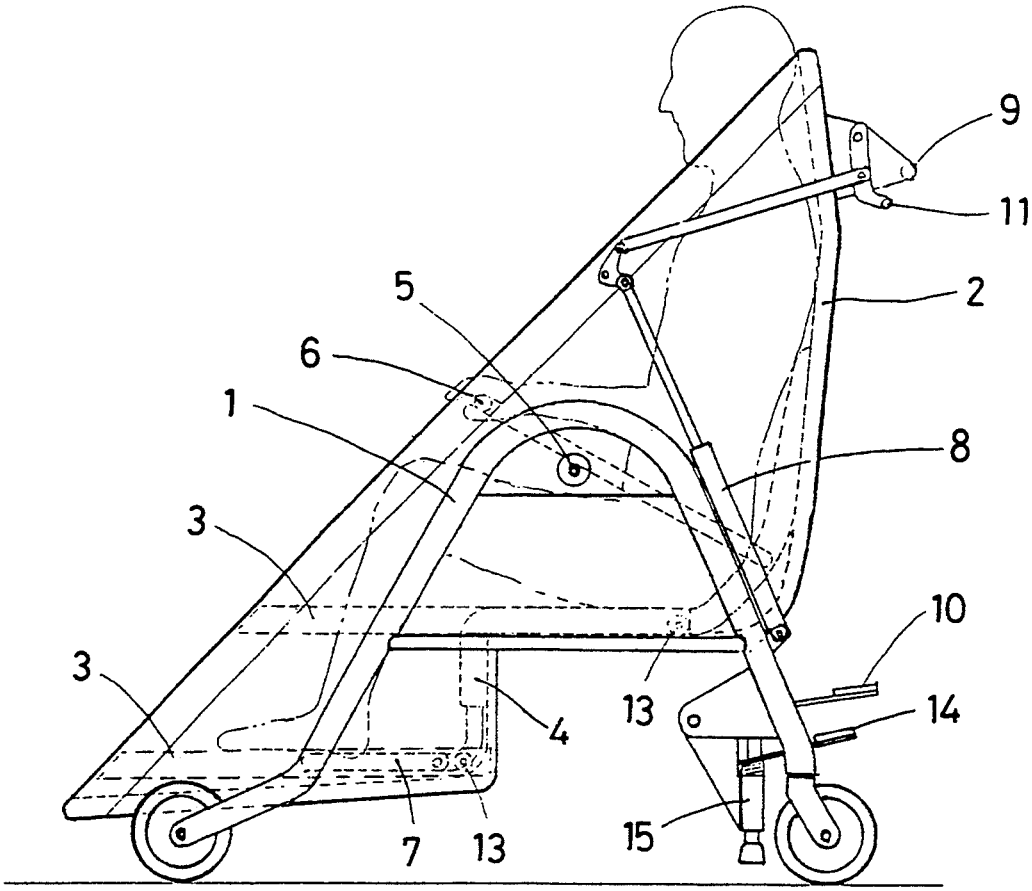
FIG. 1 is a side view of the first embodiment of the chair bath according to the present invention with the bathtub pivoted to an upright position.

The chair bath according to the present invention comprises a base frame 1 or 25 including a framework of a pair of frame members each having a side wall at the top portion thereof, support shafts 5 fixed to the side walls and protruding horizontally outwards therefrom, and a bathtub 2 rotatably mounted on the support shafts 5 so that its center of gravity will be located near the axis of the support shafts when the bathtub is filled with water.

When using this device as a chair, the bathtub 2 is turned forwardly from its horizontal position (shown in FIG. 3) by an angle of about 45°. In this state, the space under the seating surface is not used. Thus, the bathtub may be shaped such that the bottom portion is tapered inward in order to reduce the volume of the bathtub and thus to save the warm water used and the water pouring time.

A commercially available gas spring 8 having a free piston and a locking pin and a bathtub locking handle 11 for applying pressure to a locking pin of the gas spring are provided. With this arrangement, the bathtub can be turned to and locked in any desired position. In this case, the support shafts 5 are provided at a position slightly offset from the center of gravity of the bathtub so as to impart a rotating moment to the bathtub.

For higher safety in operating the bathtub, this device may be provided with a commercially available damper to limit the rotating speed.

Figure 5:
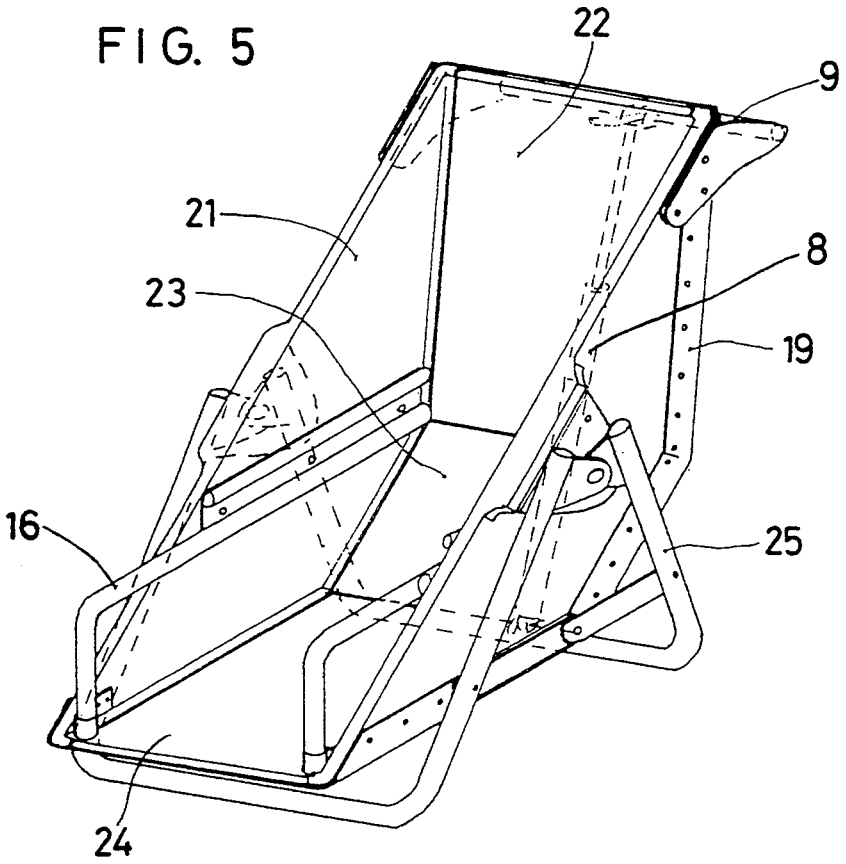
FIG. 5 is a perspective view of another embodiment of a chair bath according to the present invention.

In the embodiment of FIG. 1, guide grooves 3 are formed in both inner sides of the bathtub. A seat 4 having small wheels 13 is mounted on the bathtub with the wheels 13 slidably engaged in the corresponding guide grooves 3. In the embodiment of FIG. 5, instead of the guide grooves, guides 16 are provided for the same purpose.

The base frame 1 may be provided with wheels mounted to the framework thereof as shown in FIG. 1 so that it can be moved together with the bathtub. But as shown in another embodiment of FIG. 5, the wheels of the base frame may be omitted because the seat 4 is separated from the base frame and can be moved alone on its own wheels.

The base frame 1 and a wheel chair base frame 12 have to be provided with stoppers for keeping them immovable when they are at a stop. Conventional stoppers will suffice for this purpose. Movable armrests 6, a footrest 7, headrest (not shown), seat belt and other fastening means, which are all conventional in the art, may be provided.

Figure 2:
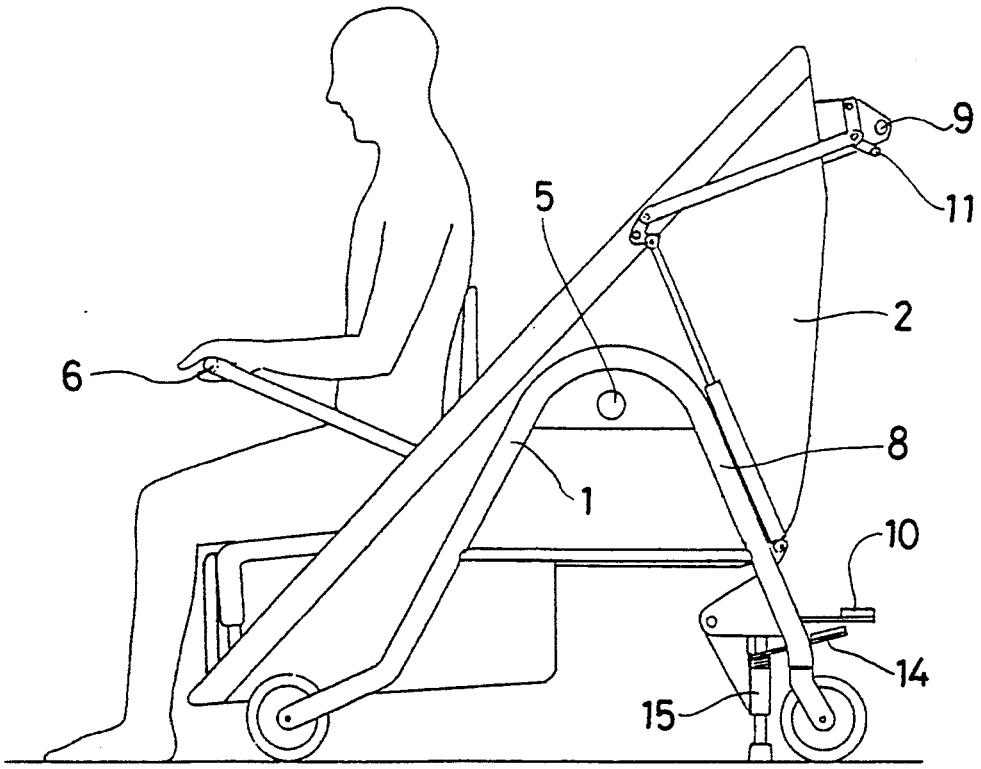
FIG. 2 is a similar view of the same with the seat pulled out so that a person can get on or off the chair or can take a shower.

Now we will describe the operation of the embodiment shown in FIGS. 1–4. The seat 4 of the chair bath, which is locked in position with a frame lock 15, is pulled forward with the footrest 7 folded in a vertical position as shown in FIG. 2. In this state, after taking off his or her clothes, a bed-ridden person or any person who cannot take a bath alone is moved from his bed onto the chair bath. The footrest 7 is folded back into the horizontal position so that the patient can rest his feed thereon. The armrests 6, having been folded in a vertical position, are also lowered so that they are located under the patient's armpits.

After adjusting the patient's sitting position, the seat 4 is pushed back deep into the bathtub. The frame lock 15 is released by operating an unlocking pedal 14 mounted on the frame 1 as shown in FIG. 1. In this state, this device can be used as a wheelchair. The helper can push the device to take the patient to a bathroom. Once in a bathroom, the helper operates a locking pedal 10 to lock the base frame 1 in position with respect to the bathroom floor. The seat is then pulled forward in the above-described manner to the position shown in FIG. 2.

Figure 3:
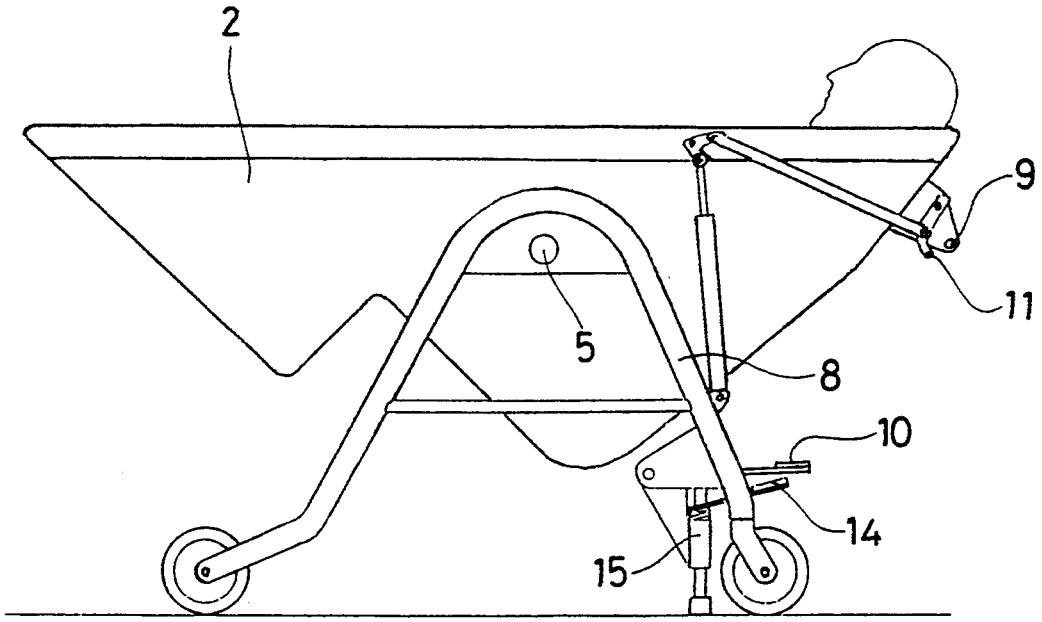
FIG. 3 is a similar view showing the bathtub of the chair bath in a horizontal position so that if can be used for taking a bath.
Figure 4:
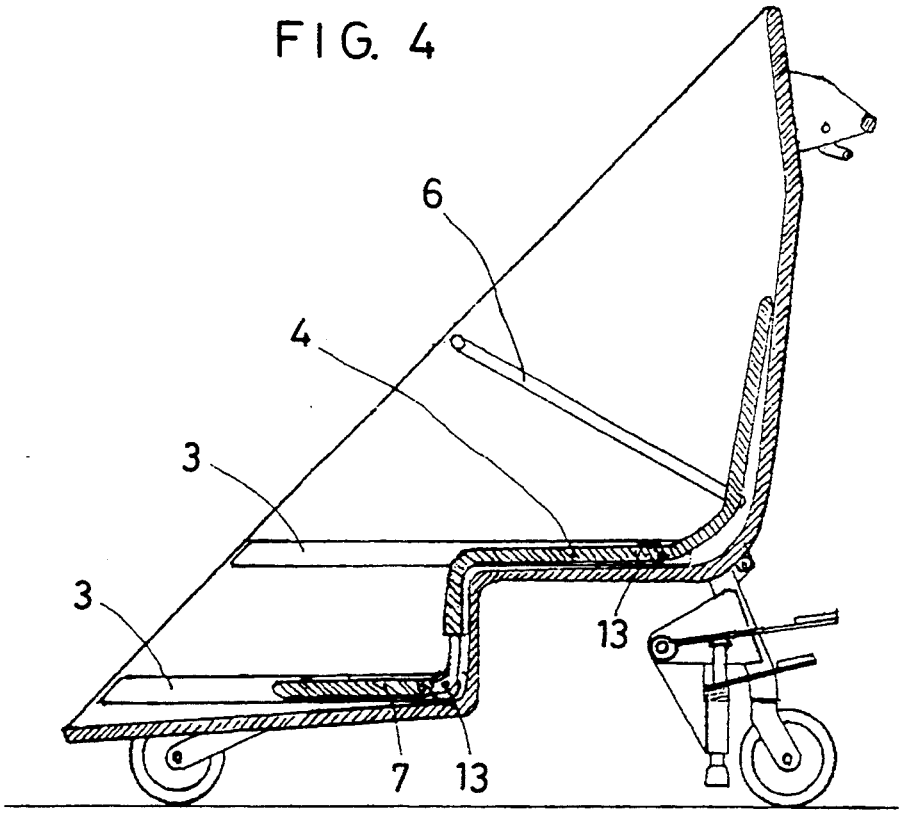
FIG. 4 is a vertical sectional view of the first embodiment.

In this state, the patient can take a shower. After washing and rinsing his body thoroughly, the seat 4 is pushed back into the bathtub to the position shown in FIG. 1. The chair bath is then moved to a position near a warm water faucet and the bathtub locking handle 11 is released so that the bathtub can be pivoted backward until it levels out as shown in FIG. 3. The bathtub is locked in position in this state. The patient is now lying on his back. Then warm water is poured into the bathtub.

When the patient's body warms up sufficiently, the bathtub is unlocked and inclined forward little by little to let the water discharge from an area near the patient's feet. The seat is then pulled forward to the position shown in FIG. 2 so that the patient can be wiped dry. The seat is pushed back to the position of FIG. 1 and the chair bath is pushed back to his bedroom.

While taking a bath, the patient does not have to leave his seat at all and the helper does not have to lift and carry him from one place to another.

In the embodiment of FIGS. 1–3, the bathtub is mounted so as to be pivotable back and forth and can be also used as a wheelchair. This eliminates an unavoidable difficulty of carrying a patient from a wheelchair to a lift.

Figure 6:
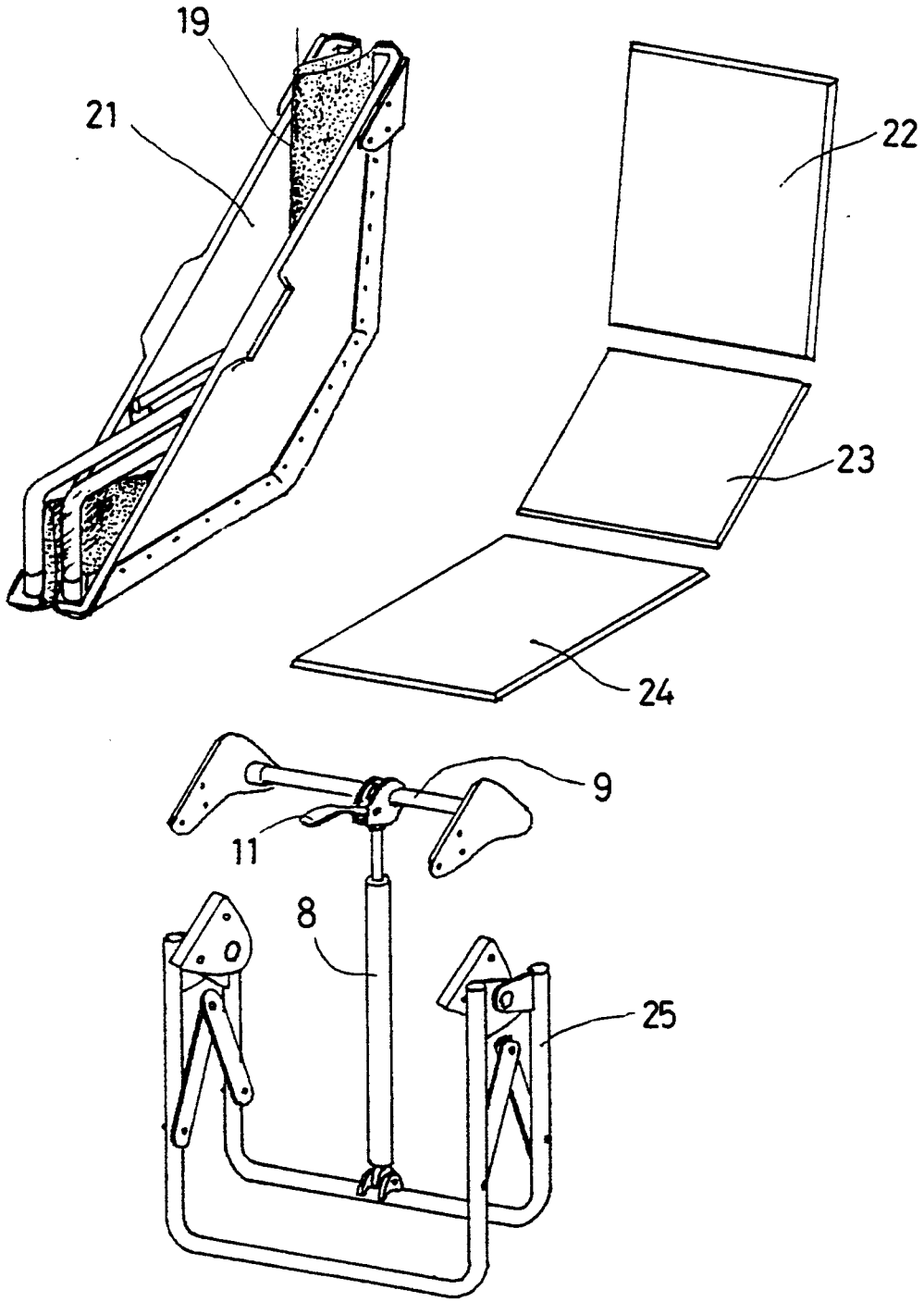
FIG. 6 is an exploded view of the same.

In the embodiment of FIGS. 5 and 6, the bathtub comprises side panels 21 connected together through the bottom member, a back panel 22, a bottom panel 23 and a foot panel 24 which are made of waterproof canvas 19 and connected together to assume the shape of the bathtub. The bathtub is mounted on a collapsible base frame 25. The assembly thus made can be stored in a narrow space or handcarried up and down stairs.

Figure 7:
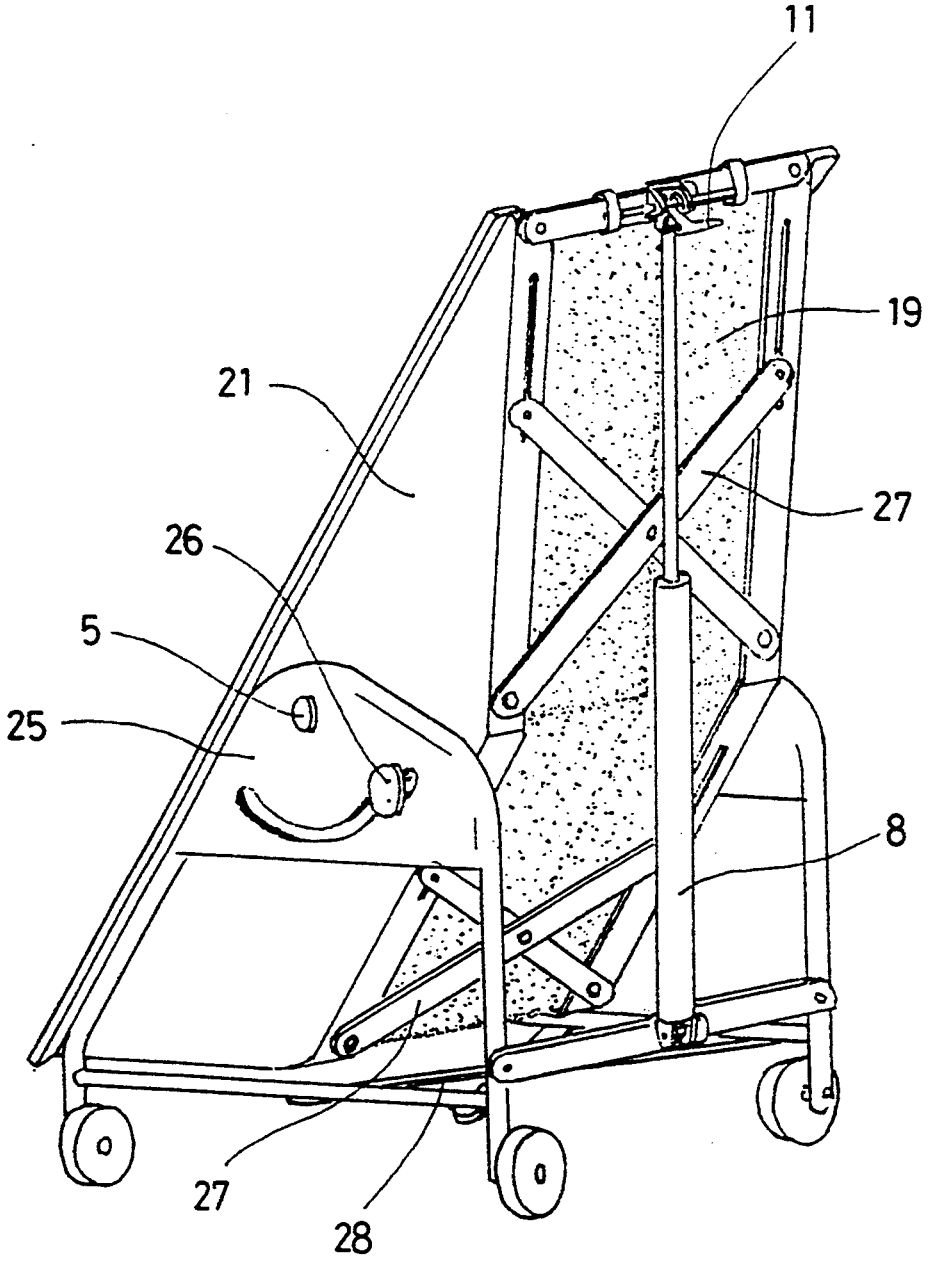
FIG. 7 is a perspective view of still another embodiment of a collapsible chair bath.
Figure 8:
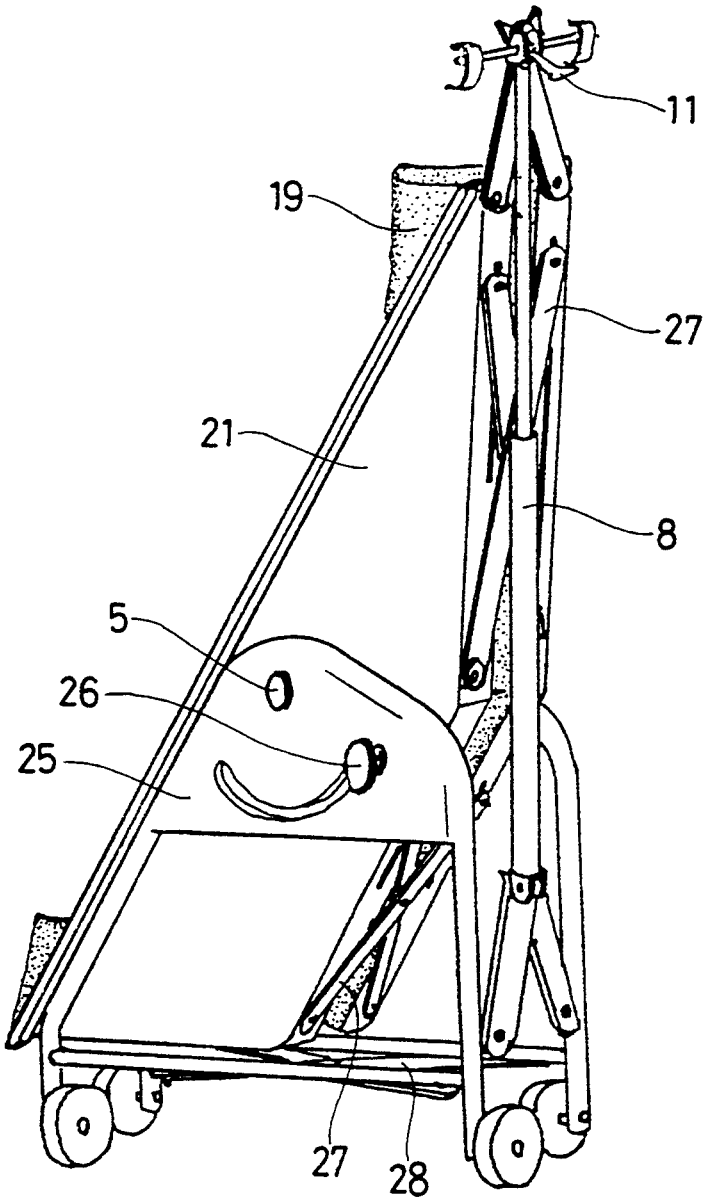
FIG. 8 is a perspective view of the same in its folded state.

The collapsible structure shown in FIGS. 7 and 8 is designed with the intention to reduce the storage space rather than to improve the ease of carrying. This chair bath includes guide pins 26 by which the base frame and the bathtub are kept close to each other when they are collapsed. Scissors 27 and 28 serve to keep both sides of the bathtub and both sides of the base frame parallel to each other when they are collapsed or expanded. When not in use, the chair bath is collapsed. Since its width is minimum in the collapsed state, it will take up lesser space when rested against a wall.

Figure 9:
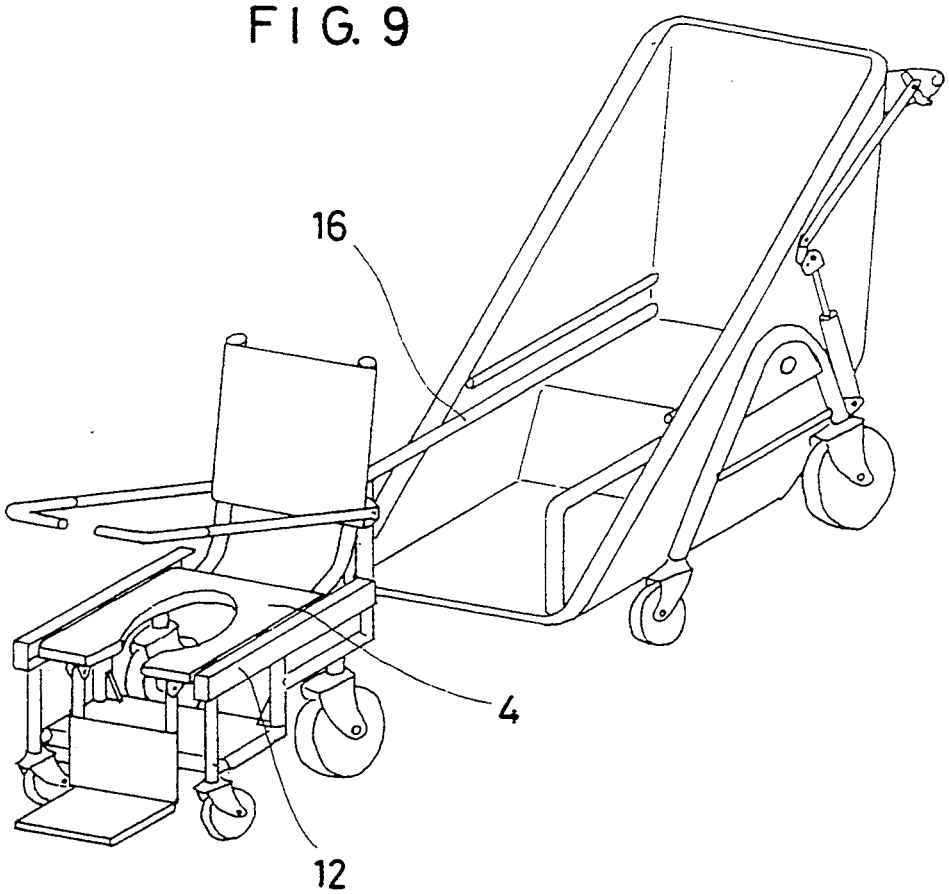
FIG. 9 is a perspective view of an embodiment of a chair-separable chair bath with the chair separated from the bathtub according to the present invention.
Figure 10:
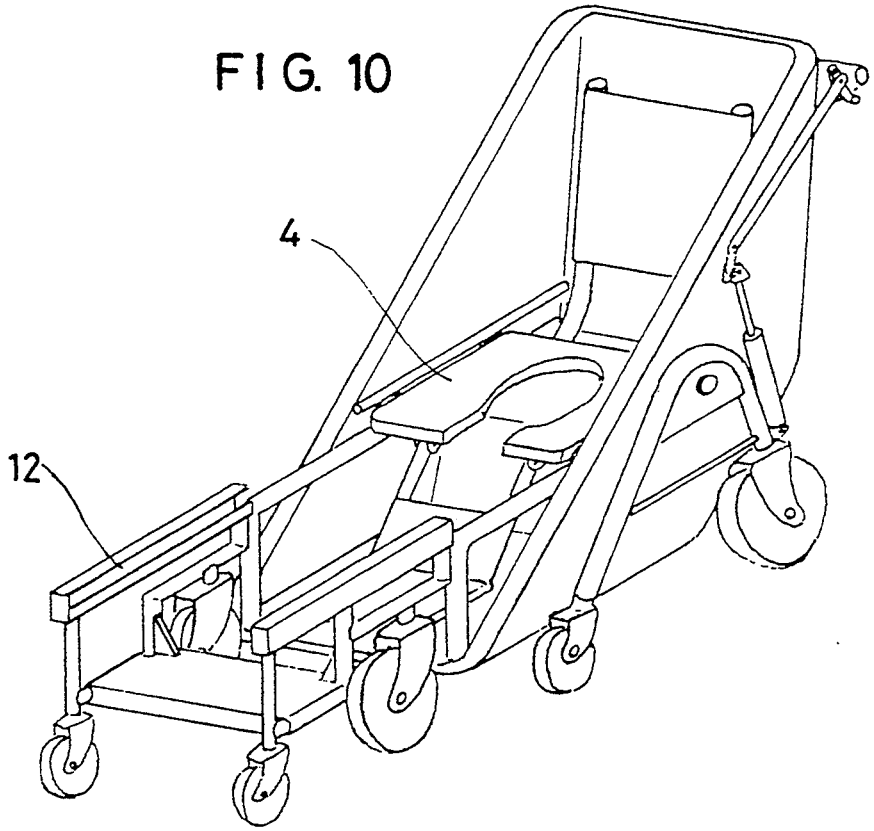
FIG. 10 is a perspective view of the same with the seat mounted on the bathtub.

FIGS. 9 and 10 show another embodiment in which the seat itself can be used as a wheelchair by separating it from the bathtub. A wheelchair is often rolled along a corridor before entering the bathroom. Thus, it is hygienically undesirable to load such a wheelchair onto the bathtub. Also, it would be difficult to load the wheelchair onto the bathtub because the rear wheels can be major obstacles. To solve this problem, the seat 4 of the wheelchair of this embodiment of the chair bath is separable from its base frame 12 carrying the wheels.

In order to move the seat 4 from the bathtub to the wheeled base frame 12, the rear end of the base frame 12 is brought close to the front end of the bathtub, which is kept in a forwardly inclined position. Then, the seat is pulled forward along the extension guide 16 until it is completely moved onto the wheeled frame 12. In order to move the seat from the wheeled frame to the bathtub, the above operation is reversed.

Figure 11:
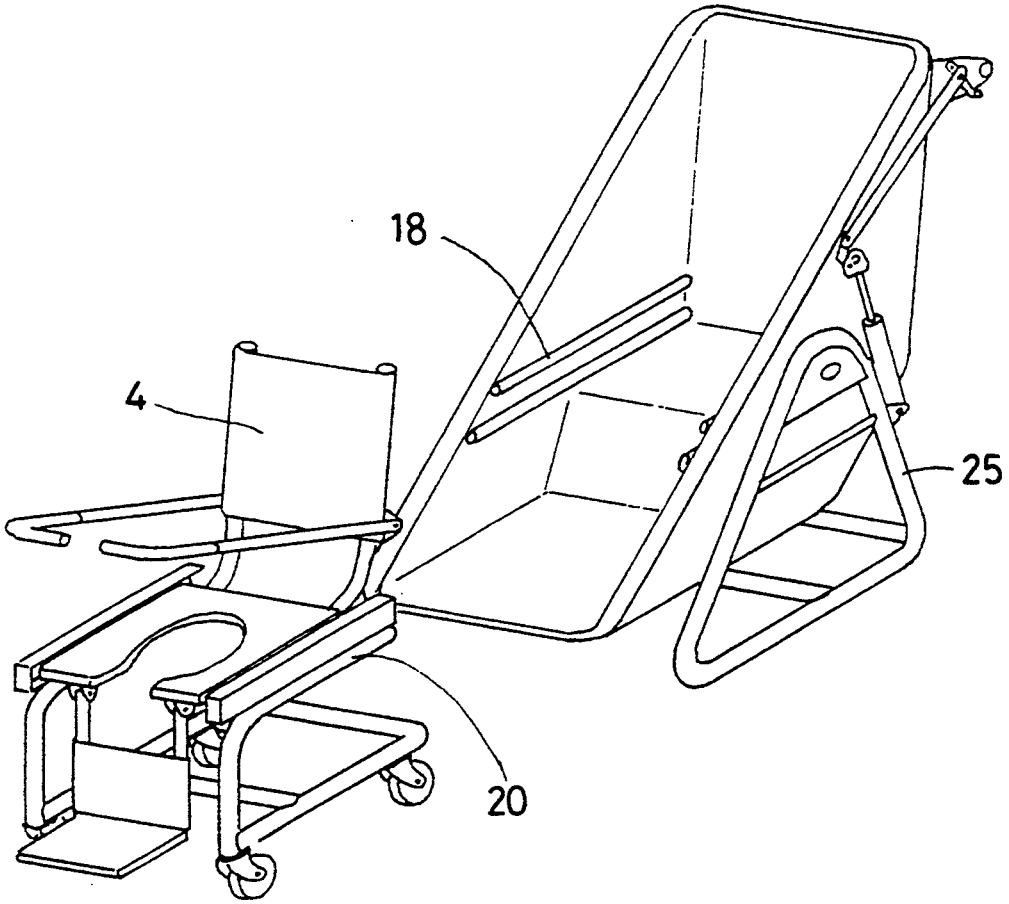
FIG. 11 is a perspective view of another embodiment.

FIG. 11 shows an alternative embodiment, in which the seat is supported on a suspension type wheeled base frame 21. In order to move the seat 4 onto the bathtub, the wheelchair is pushed toward the bathtub until the wheel-carrying lower part of the base frame 21 slips under the front edge of the bathtub and its upper part is moved over the front edge. Then, the seat 4 is pushed further deep into the bathtub along the guide 18.

Various features of the above embodiments may be combined in many different ways according to the intended use of the chair bath. The chair bath of the present invention can be used for taking a bed-ridden person out of doors for sunbathing. In this case, a suitable cushion such as a blanket should be laid under the patient so that he can stay outside comfortably for a long time.

What is claimed is:

1. A chair bath comprising: a base frame including a framework and wheels mounted to the framework at a bottom portion thereof so that the base frame is rollable along the ground; a bathtub rotatably mounted to said base frame about an axis transverse to said bathtub so that said bathtub is pivotable about said axis relative to said base frame; means for locking said bathtub relative to said base frame; and a seat movably mounted in said bathtub so that it can be pulled out in a horizontal forward direction once the bathtub has been pivoted to an upright position.

2. A chair bath as claimed in claim 1, wherein said bathtub is collapsible.

3. A chair bath system comprising: a wheelchair including a base having wheels, and a seat slidably supported by said base so as to slidable out of said base; a base frame; a bathtub rotatably mounted to said base frame about an axis transverse to the bathtub so that said bathtub is pivotable about said axis relative to said base frame between an upright position and a horizontal position, said bathtub including guide means for slidably supporting the seat of said wheelchair; and means for locking said bathtub relative to said base frame in either of said positions; said guide means being located at the same level as the seat of said wheelchair when said bathtub is in the upright position thereof such that the seat of the wheelchair is slidable from the wheelchair and into the bathtub as supported by the guide means when the bathtub is in said upright position thereof.

4. A chair bath system as claimed in claim 3, wherein said base frame includes a framework and wheels mounted to the framework at a bottom portion thereof so that the base frame is rollable along the ground.

5. A chair bath system as claimed in claim 3, wherein said bathtub is collapsible.

* * * * *